US005913426A

United States Patent [19]

Lotz Renfro et al.

[11] Patent Number: 5,913,426

[45] Date of Patent: Jun. 22, 1999

[54] CONTAINER FOR HOLDING AND DISPLAYING ELONGATED OBJECTS

[76] Inventors: Heidi R. Lotz Renfro, 929 Clear View Dr., Bedford, Tex. 76021; James J. Brown, 24 Marshall St., W. Caldwell, N.J. 07006; Henry Renella, 53 Jay St., Bardonia, N.Y. 10954; Joseph Petruska, 6 Arthur Ct., Montvale, N.J. 07645; Wilhelm B. Bronander, 55 Burma Rd., Wyckoff, N.J. 07481

[21] Appl. No.: 08/811,148

[22] Filed: Mar. 4, 1997

[51] Int. Cl.[6] ..... B65D 73/00

[52] U.S. Cl. ..... 206/763; 206/485; 206/564

[58] Field of Search ..... 206/756, 763, 206/387.17, 477, 483, 775, 476, 485, 562, 564, 565

[56] References Cited

U.S. PATENT DOCUMENTS

| | | | |
|---|---|---|---|
| 1,684,579 | 9/1928 | Ferguson et al. | 206/763 |
| 3,073,440 | 1/1963 | Jones . | |
| 3,314,530 | 4/1967 | Michalka . | |
| 3,669,251 | 6/1972 | Phillips, Jr. . | |
| 3,756,385 | 9/1973 | Steinbock . | |
| 3,927,761 | 12/1975 | Boyle | 206/756 |
| 4,485,922 | 12/1984 | Desmond et al. | 206/485 |
| 4,832,199 | 5/1989 | Rigby | 206/485 |
| 5,344,019 | 9/1994 | Van Hest | 206/485 |
| 5,505,309 | 4/1996 | Tarvella et al. | 206/485 |

OTHER PUBLICATIONS

Photographs of flat and box for holding TUMS® packages (3 photographs).

*Primary Examiner*—Paul T. Sewell
*Assistant Examiner*—Nhan T. Lam
*Attorney, Agent, or Firm*—Covington & Burling

[57] ABSTRACT

A container for holding and displaying elongated objects in an upright, vertical position. The container includes a double side wall assembly formed by folding a folding panel against a side wall and adhering it to the bottom of the container. Because the folding panel is of slightly greater length than the side wall, when the container is erected, the folding panel buckles inward to engage the contained objects and hold them in an upright position. The folding panel may form cavities for receiving and engaging the contained objects. The invention also provides a planar blank for making such a container, as well as a substantially flat, glued blank for use with automatic packaging equipment. The container of this invention is machine formable, thereby facilitating efficient forming and loading of the container by the packager, manufacturer or distributor of the merchandise to be displayed.

13 Claims, 8 Drawing Sheets

CONTAINER FOR HOLDING AND DISPLAYING ELONGATED OBJECTS

BACKGROUND OF THE INVENTION

This invention relates to containers for the upright holding and displaying of merchandise-containing elongated sleeves or cartons. In particular, the container of this invention retains the merchandise in an upright vertical position even when the container is only partially loaded with its contents. In addition, the container of this invention is machine formable, thereby facilitating efficient forming and loading of the container by the packager, manufacturer or distributor of the merchandise to be displayed. In this manner, the container of this invention can be used for shipping as well as displaying the contained merchandise.

DESCRIPTION OF THE RELEVANT ART

Various prior art containers for holding and displaying carded or boxed merchandise in a vertical orientation exist, but none of them offers the benefits of the present invention. For example, Steinbock, U.S. Pat. No. 3,756,385, teaches a hand-formed double endwall tray with multiple opposed and inwardly folded retaining tabs opposingly arranged on the side panels which frictionally hold contents upright and stationary. While the Steinbock tray effectively holds the merchandise upright, it requires complex hand formation in order to actuate the numerous retaining tabs as merchandise is loaded. In addition, because the tray of Steinbock is not machine formable, it is not easily used for mechanically packaging merchandise at the manufacturer's facility.

Michalka, U.S. Pat. No. 3,314,530, teaches a collapsible slotted tray to be shipped flat with carded products for erection and filling at the point of sale. Like the Steinbock tray, the Michalka tray design does not permit the forming and filling steps to be completed simultaneously.

Some other containers that are presently being used for displaying elongated objects do not even feature means for holding the elongated objects in place, as shown in FIG. 5, where the container of the present invention is depicted alongside a container that is currently in use.

SUMMARY OF THE INVENTION

An object of the present invention is to provide a container for holding and displaying elongated objects or packages in a vertical position with a high degree of flexibility and increased functionality over conventional containers for holding elongated objects or packages containing secondary merchandise.

Another object of the invention is to provide a means for ensuring that elongated packages or products in a container continue to stand vertically even when adjacent packages are removed from the container.

Another object of the invention is to provide a means for holding elongated packages or products upright in a container where the height of the container is considerably less than the height of the elongated packages or products.

Another object of the present invent-on is to provide a container with a double sidewall structure forming struts and cavities for holding elongated packages or products.

Another object of the present invention is to provide a container for holding elongated packages or products that can be automatically formed and sealed on existing packaging equipment.

A further object of the present invention is to provide a container for holding elongated packages or products that can also serve as a unitizing wrap for shipping merchandise in multiple wraps secured in a shipping case of standard structure.

Another object of the present invention is to provide a container for holding elongated packages or products that can be formed and wrapped with its contents on existing packaging machinery.

Another object of the present invention is to provide a container for holding elongated packages or products that can efficiently be filled by the packager, distributor, or manufacturer of the elongated packages or products, rather than at the point of sale.

Another object of the present invention is to provide means for wrapping merchandise that can be applied by the manufacturer prior to shipping and that serves as a container at the point of sale.

The present invention, as broadly described herein, provides a container for displaying a plurality of items comprising a rectangular bottom panel having a first side edge, a second side edge, and opposing end edges; a first side wall panel extending upwardly from the first side edge and having an upper edge; a folding panel hinged to and extending from the upper edge of the first side wall panel having an edge positioned near the first side edge of the rectangular bottom panel; wherein the width of the rectangular bottom panel substantially conforms to a dimension of each of the plurality of items; and wherein the folding panel comprises means for receiving the plurality of items.

In addition, the present invention provides a planar blank of paperboard or suitable flexible material for forming into a container for displaying a plurality of items. The planar blank comprises a rectangular bottom panel having a first side edge, a second side edge, and opposing end edges; a first side panel extending outwardly from the first side edge and having an upper edge; a folding panel extending from the upper edge of the first side panel; wherein the width of the rectangular bottom panel substantially conforms to a dimension of each of the plurality of items; and wherein the folding panel comprises means for receiving the plurality of items.

The invention further provides a planar blank for forming a container of suitable flexible material for displaying a plurality of items, where the container blank is also used to wrap the plurality of items for shipping.

DETAILED DESCRIPTION OF THE PREFERRED EMBODIMENTS

Figure 1:
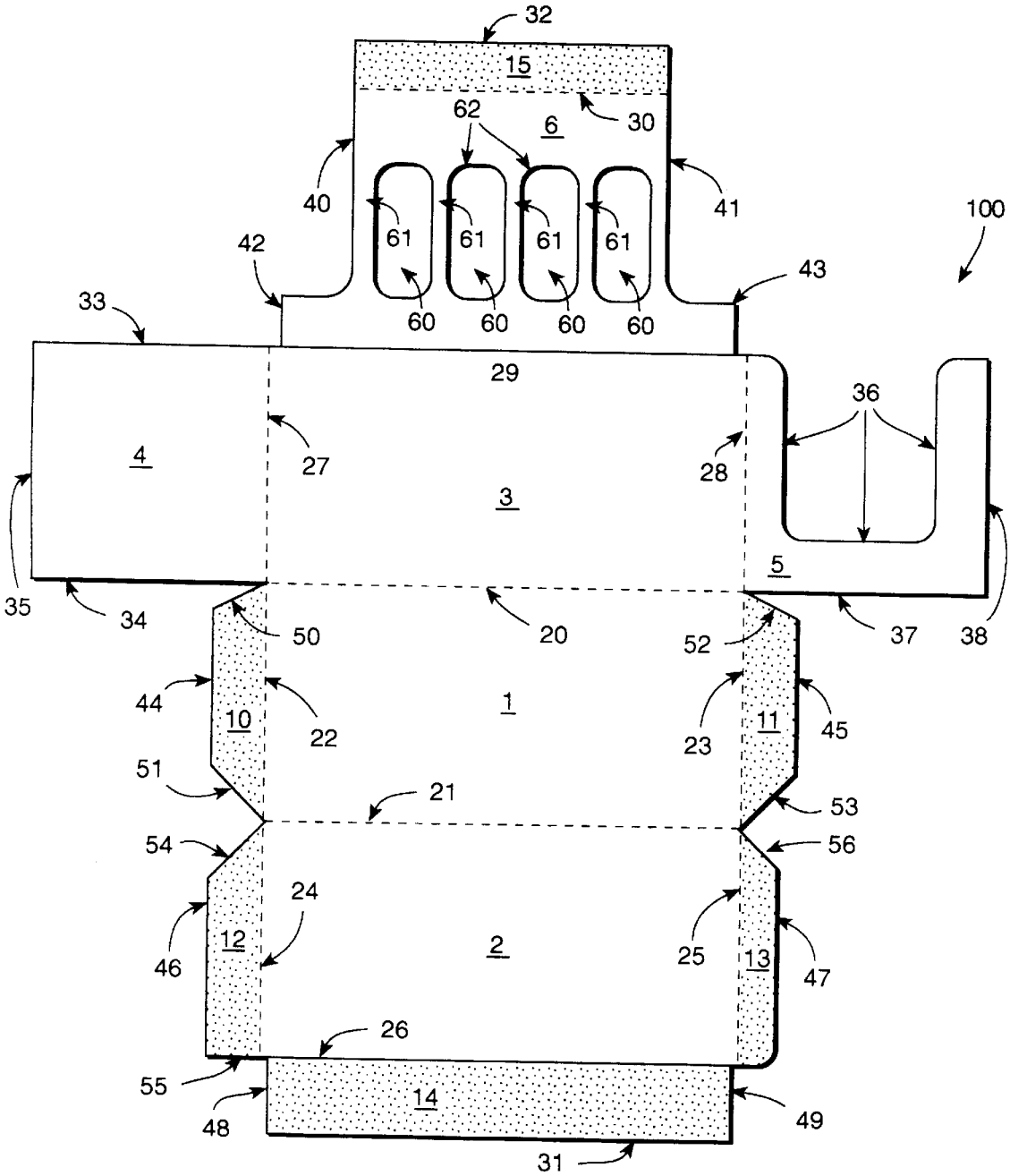
FIG. 1 is an extended plan view of a planar blank as cut and scored for constructing the container or wrap of the present invention.

Reference will now be made in detail to the present preferred embodiments of the invention, examples of which are illustrated in the accompanying drawings, wherein like reference numerals indicate like elements throughout the several views.

FIG. 1 depicts a preferred embodiment of a planar blank 100 for a container of the present invention, where the planar blank 100 is a shaped piece of flexible material such as paperboard or fluted linerboard construction (such as F flute) that may be folded along its scored lines to form a container. For purposes of this description, any edge between two adjacent sides, panels, flanges or flaps is scored, such that a fold can be readily made to cause the adjacent panels to be perpendicular to each other, or, in some cases, such that a flap can be folded over 180° and adhered to an adjacent flap or other panel. The planar blank 100 comprises a rectangular bottom panel 1 having a first side edge depicted in FIG. 1 as right side edge 20, a second side edge depicted in FIG. 1 as left side edge 21, and opposing end edges 22 and 23; a first side panel depicted in FIG. 1 as right side panel 3 extending outwardly from right side edge 20 and having an upper edge 29; a folding panel 6 extending outwardly from upper edge 29 of right side panel 3. In the preferred embodiment depicted in FIG. 1, folding panel 6 comprises means for receiving a plurality of items, where the width of rectangular bottom panel 1 substantially conforms to a dimension of each of the plurality of items. In the preferred embodiment of FIG. 1, the means for receiving a plurality of items comprises a strut and cavity assembly comprising struts 61 and cavities 60 formed in folding panel 6.

As further depicted in FIG. 1, in a preferred embodiment, right side panel 3 is rectangular and comprises opposing edges 27 and 28. Front panel 5 extends outwardly from right side panel 3 at edge 28, and back panel 4 extends from right side panel 3 at edge 27. In a preferred embodiment, front panel 5 features a cut-away design that facilitates viewing of merchandise from the front of the formed container. In the preferred embodiment depicted in FIG. 1, front panel 5 is substantially U-shaped, where the inner sides of the U are shown in FIG. 1 as edge 36. In a preferred embodiment, back panel 4 is rectangular in shape.

In the preferred embodiment depicted in FIG. 1, planar blank 100 further comprises left side panel 2 extending outwardly from left edge 21 of bottom panel 1. Left side panel 2 is rectangular in shape and comprises edge 21 held in common with bottom panel 1, opposing edges 24 and 25, and edge 26 opposite edge 21. In the preferred embodiment depicted in FIG. 1, extension panel 14 extends outwardly from edge 26.

The preferred embodiment depicted in FIG. 1 further comprises glue flanges 10 and 11 extending outwardly from bottom panel 1 at edges 22 and 23, and glue flanges 12 and 13 extending outwardly from left side panel 2 at edges 24 and 25. In a preferred embodiment, edge 54 of glue flange 12 and edge 51 of glue flange 10 form a 90° angle at their intersection at edge 21 so that when a fold is made along edge 21 such that left side panel 2 is normal to bottom panel 1, and folds are made along edges 22 and 24 so that glue flanges 10 and 12 are normal to bottom panel 1 and left side panel 2 respectively, edge 54 is substantially aligned with edge 51. In a similar manner, edges 53 and 56 of glue flanges 11 and 13 line up when perpendicular folds are made along edges 21, 23 and 25. In the preferred embodiment shown in FIG. 1, edge 50 of glue flange 10 extends diagonally outward and away from back panel 4 from a point on edge 22 near the intersection of edges 20 and 22, and edge 52 of glue flange 11 extends diagonally outward and away from front panel 5 from a point on edge 23 near the intersection of edges 20 and 23.

Figure 2A:
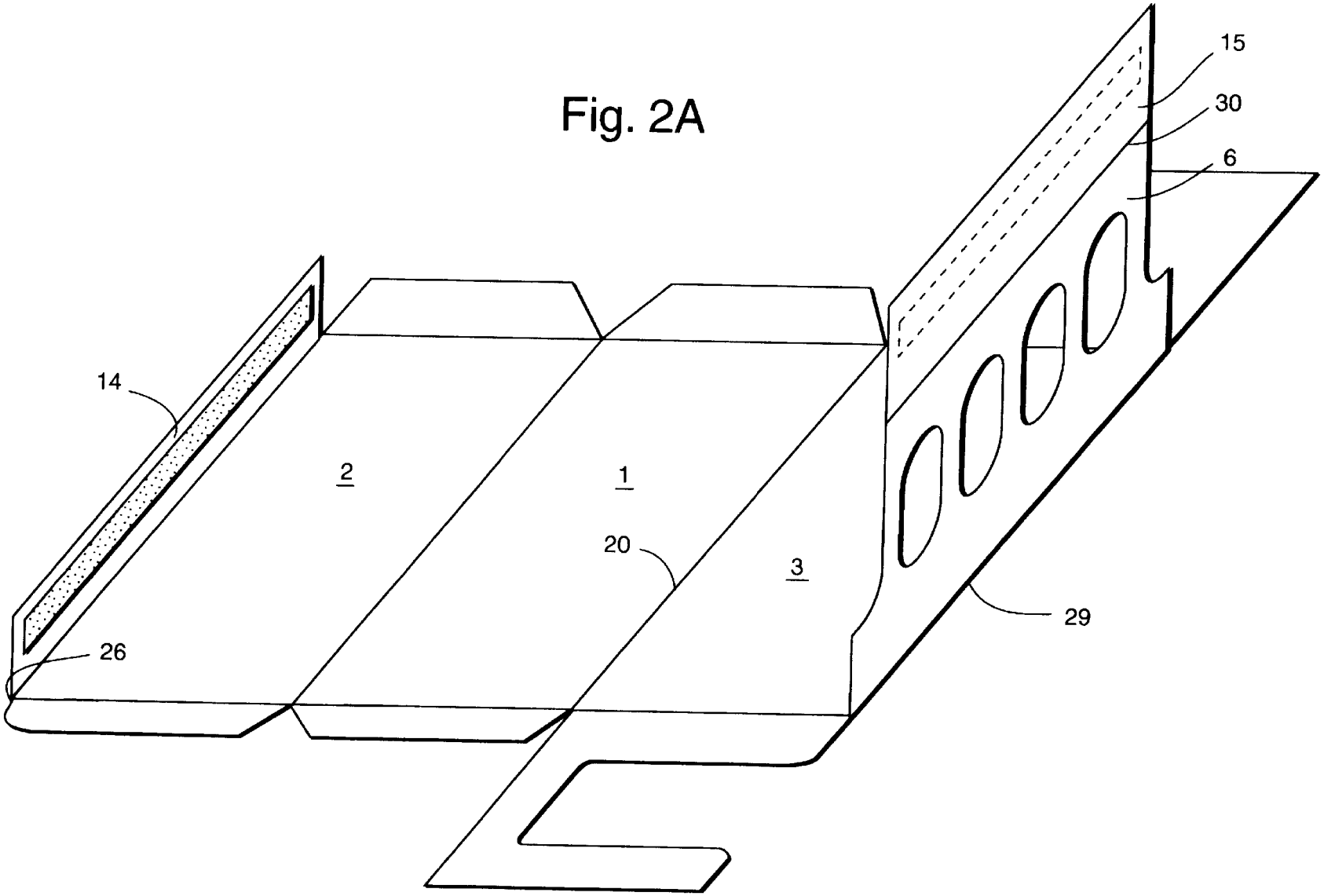
FIG. 2A is a perspective view of the planar blank in an intermediate position showing folds made in order to make a substantially flat shippable blank.
Figure 2B:
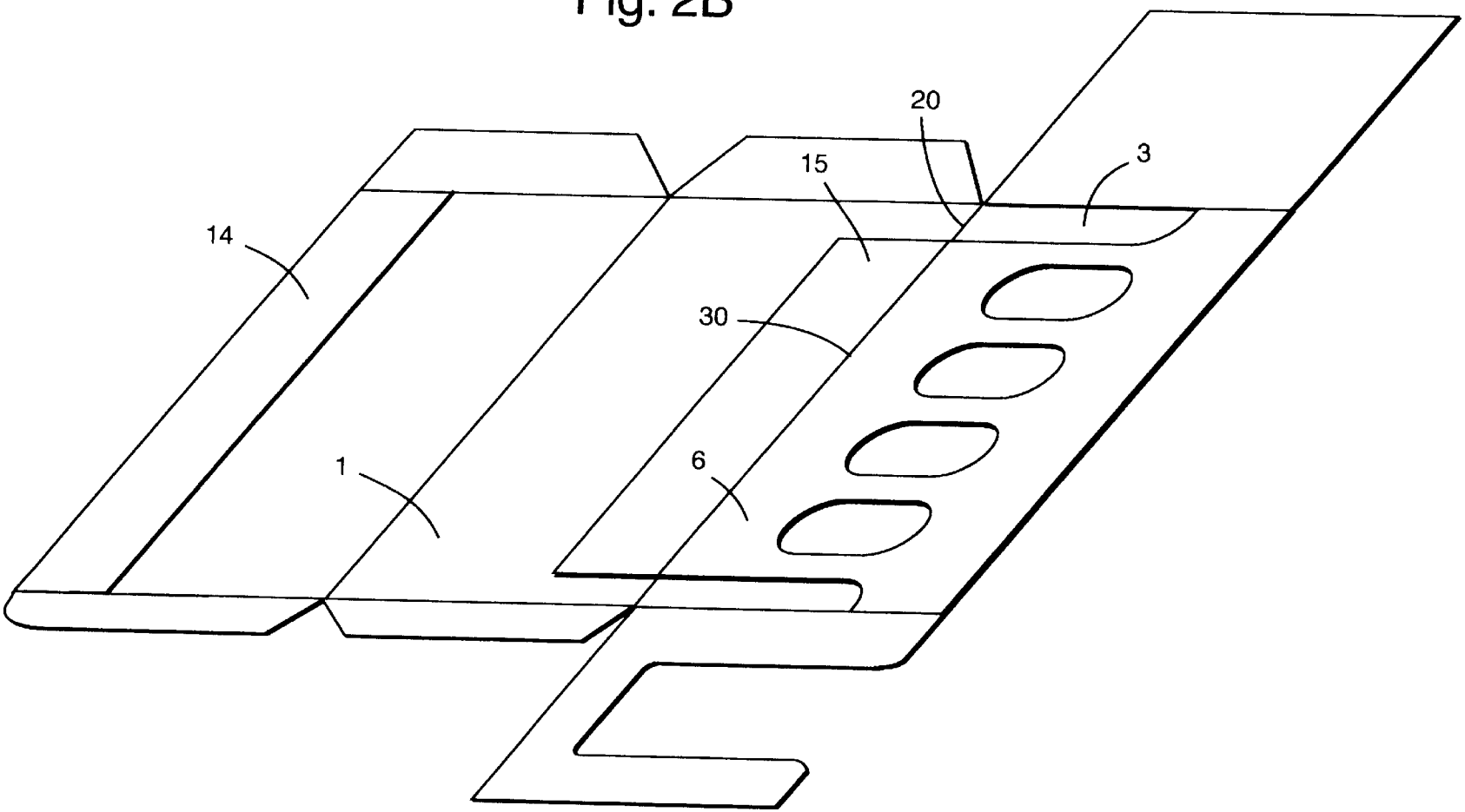
FIG. 2B is a perspective view showing the container blank of the present invention, in folded, glued condition for shipping.
Figure 2C:
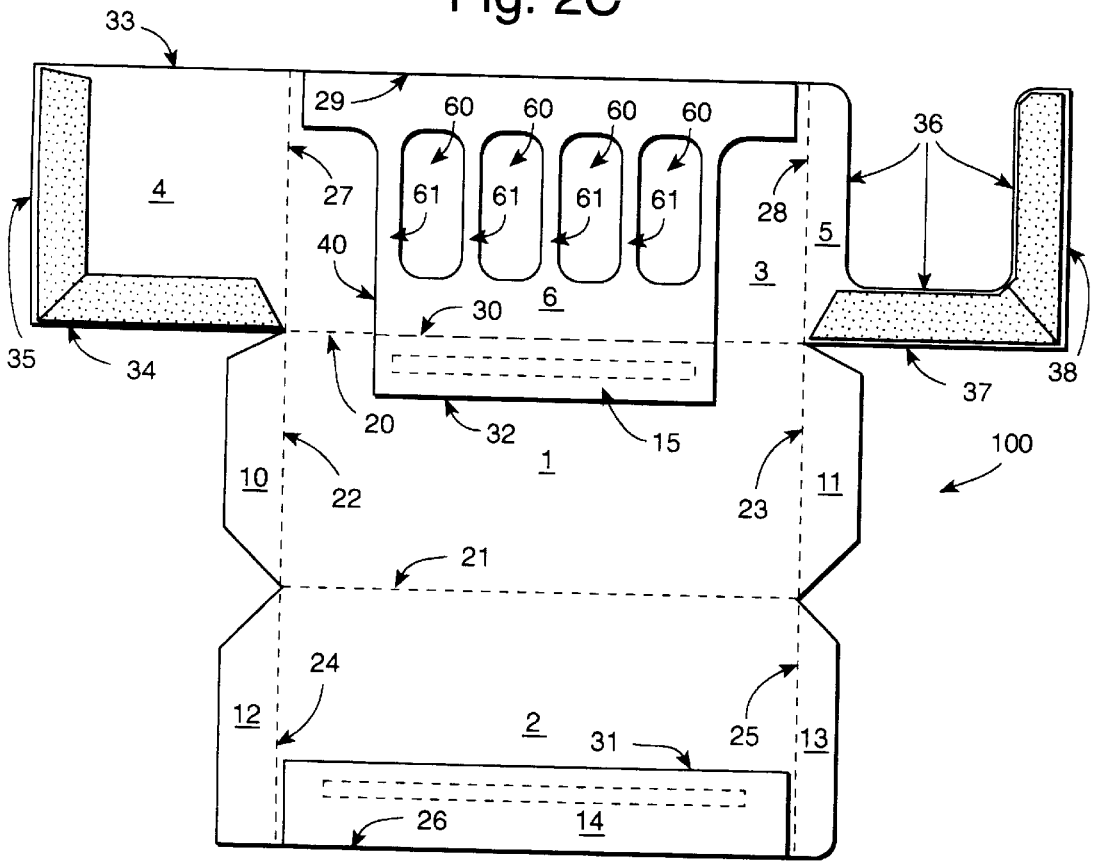
FIG. 2C is a plan view showing of the container of the present invention, in folded, glued condition for shipping.

In a preferred embodiment, a container is constructed from the planar blank 100 of FIG. 1 in two steps, as can be seen with reference to FIGS. 2A, 2B, and 2C. First, the paperboard blank is formed into a substantially flat, shippable blank, as can be accomplished by the container manufacturer using the manufacturer's standard straight line gluing equipment. Such a flat, shippable blank may be referred to by those with skill in the art as a "KDF" or "Knocked-Down-Flat" shippable blank. To form such a substantially flat, shippable blank, extension panel 14 is folded over inwardly along edge 26 and adhered to left side panel 2. This creates a double wall and spine for rigidity of the container structure. In addition, folding panel 6 is folded inwardly along edge 29 to form a double wall against right side panel 3, such that edge 30 lies atop edge 20. Extension glue foot panel 15 is then adhered to bottom panel 1. FIG. 2A depicts the initial partial folds that are made along edges 26 and 29. FIG. 2B is a perspective view showing the substantially flat, glued, shippable blank produced in accordance with this procedure.

On FIG. 2C, a plan view of blank 100 in a folded, glued, shippable condition, manufacturer's glue joints are shown as tracks with diagonal lines at the location where glue foot panel 15 is glued to rectangular bottom panel 1, and the location where extension panel 14 is glued to left side panel 2. FIG. 2C also shows as shaded patterns the respective receptor areas for glue flanges 10, 11, 12, 13 which will be conjoined to form back panel 4 and front panel 5 during packaging line erection.

The present invention also includes a container formed from the planar blank 100 of FIG. 1, or the shippable blank described in connection with FIG. 2A–2C. The container includes a rectangular bottom panel 1, from which extend glue flanges 10 and 11, right side panel 3 and left side panel 2. Glue flanges 10 and 11 are folded upwardly approximately 90° along edges 22 and 23, respectively, such that they extend perpendicularly to bottom panel 1. Folding panel 6 is folded inwardly 180° along edge 29, such that edge 30 lines up substantially with edge 20, and glue foot 15 is adhered to bottom panel 1. Right side panel 3 is folded upwardly approximately 90° along edge 20 such that right side panel 3 extends perpendicularly to bottom panel 1. Because folding panel 6 is of slightly greater height than right side panel 3, folding panel 6 buckles inward to the center of the container when right side panel 3 is erected, resulting in the formation of a double-wall strut and cavity structure comprising struts 61 and cavities 60 for retaining elongated packages vertically in place.

Glue flanges 12 and 13 extending from left side panel 2 are folded upwardly approximately 90° along edges 24 and 25, respectively, and left side panel 2 is folded upwardly approximately 90° along edge 21. Extension panel 14 is folded inwardly 180° along edge 26 and adhered to left side panel 2 to form a partial double wall. Front panel 5 is folded inwardly approximately 90° along edge 28 and is adhered to glue flanges 11 and 13. Back panel 4 is folded inwardly approximately 90° along edge 27 and is adhered to glue flanges 10 and 12.

Figure 3:
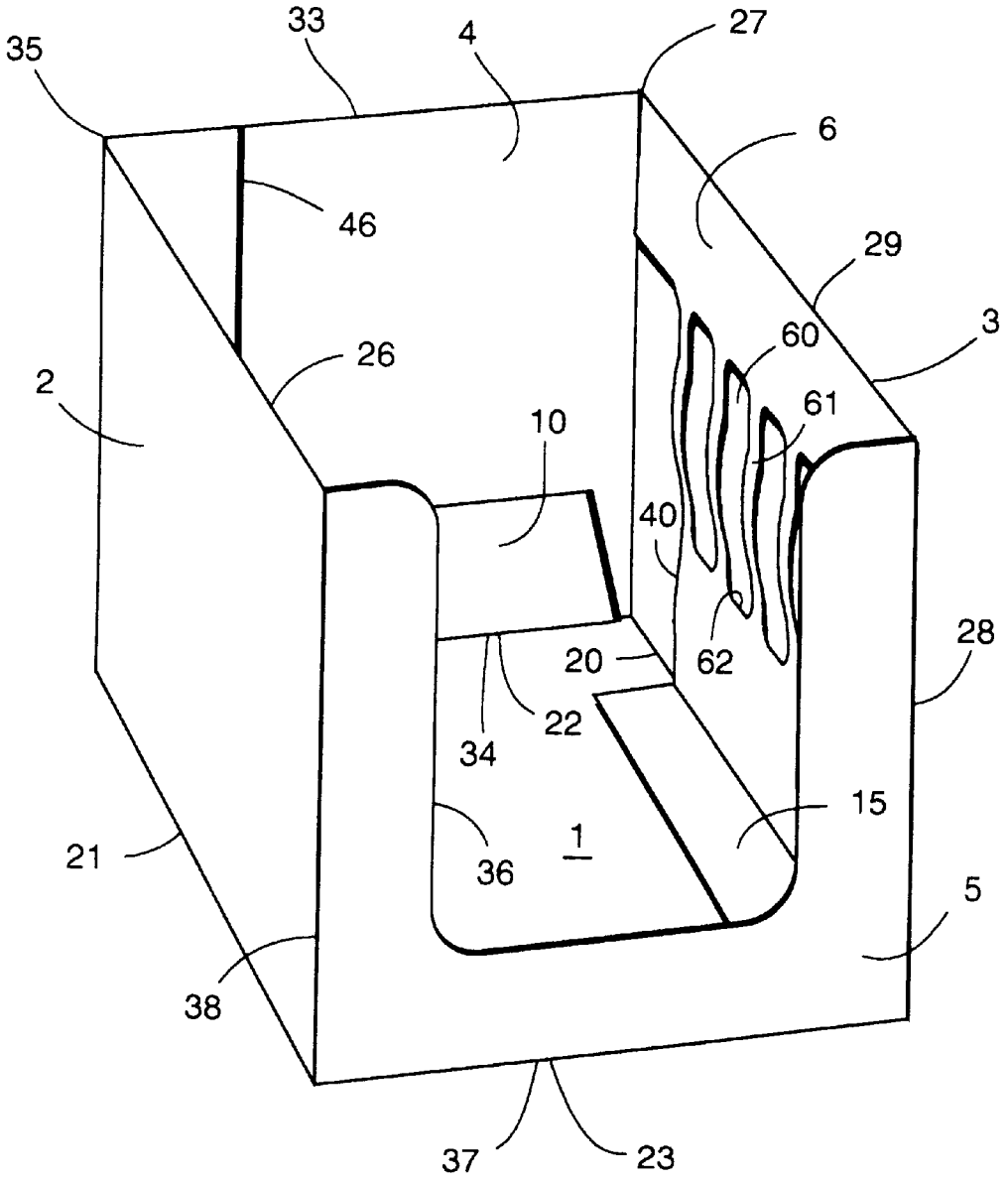
FIG. 3 is a perspective view of the container of the present invention showing a display cut-away front and shape of struts which create adjacent cavities for positioning of multiple elongated sleeves or cartons.
Figure 4:
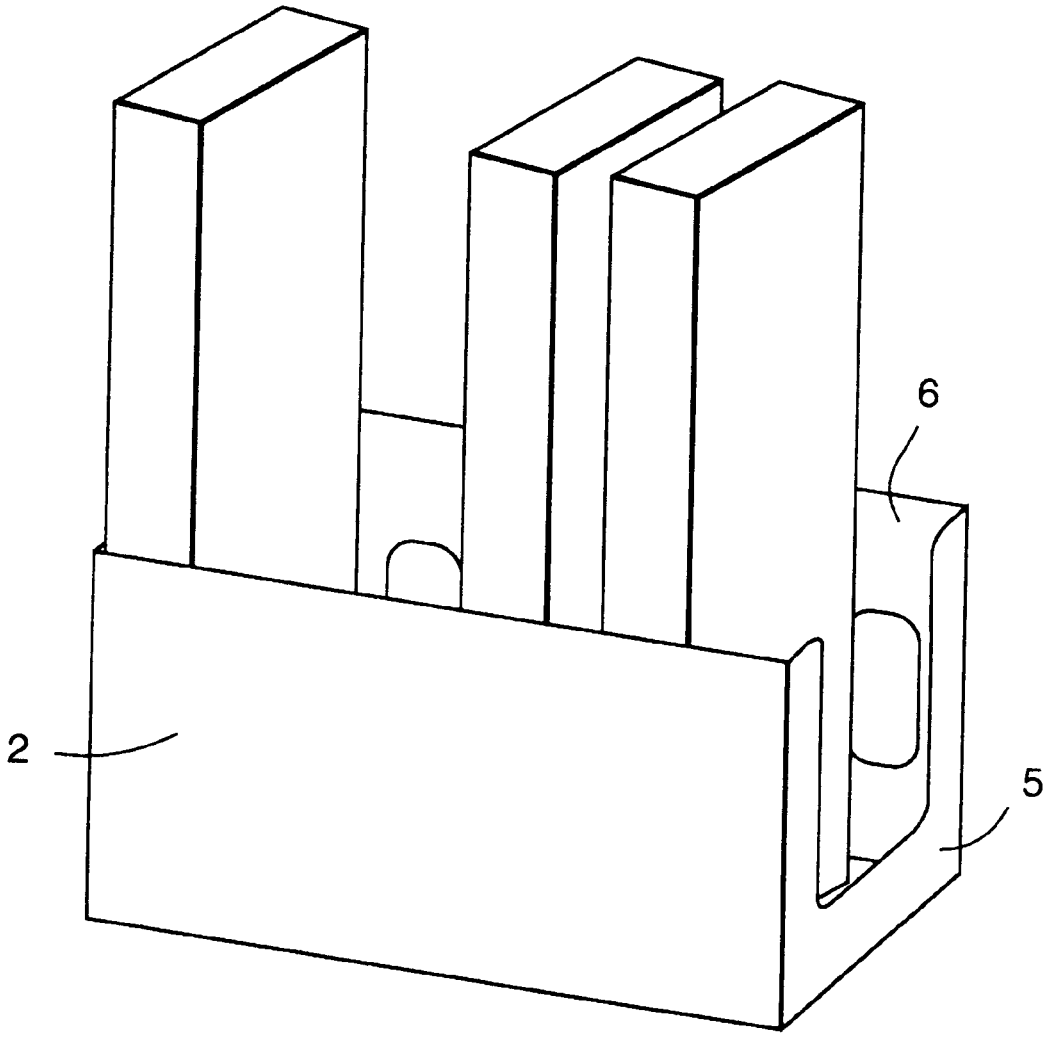
FIG. 4 is a perspective view of the container of the present invention partially loaded with adjacent multiple elongated cartons.
Figure 5:
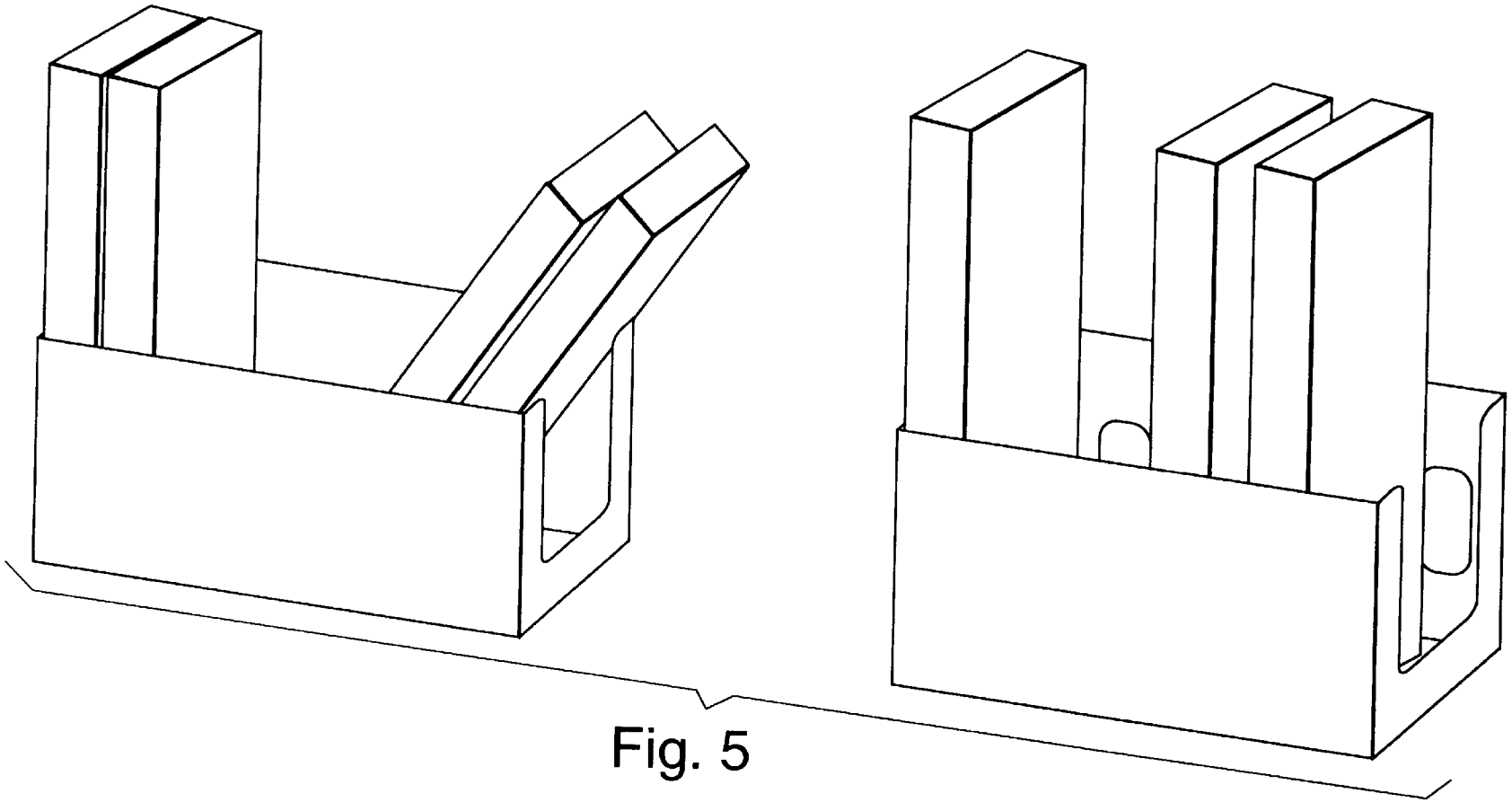
FIG. 5 depicts the vertical retention of elongated cartons and sleeves in a container of the present invention, as compared to competitive packaging showing lack of vertical retention.

As depicted in FIGS. 3–5 the container as finally formed is defined at its top by score lines 26 and 29 and cut lines 33 (back panel) and 36 (front panel cut-away). The back panel is defined by score line 27 and cut lines 33, 34, 35. The front panel 5 is defined by score line 28 and cut lines 36, 37, 38 with cut line 36 forming a cut-away feature for observation of the printed display message on the interior contents of vertically positioned elongated merchandise, sleeves or cartons. The sleeves or cartons hold the merchandise as advertised in the printed display on their faces. Unwrapped, bar-shaped rigid merchandise, or suitably rigid bagged merchandise, may also be contained in the container in an upright position. The double wall, extra length support formed by right side panel 3 and folding panel 6 functions as the interior support system by forming bowed support struts 61, as defined by cut lines 40, 41, 62, and merchandise receptor cavities 60 as defined by generally rectangular cut lines 62. In a preferred embodiment, the merchandise contained in the container of the invention comprises sleeved packages of two cylindrical objects, such as household air fresheners, where a portion of the curved side of the lower of the two cylindrical objects protrudes from the side of the sleeve and is held in place by merchandise receptor cavity 60. The length of side panels 2 and 3 and of the support side panel 6 may be altered along with a suitable quantity of struts and cavities to accommodate more or fewer cartons. The container bottom is defined by score lines 20, 21, 22, 23, which serve as right angle hinges for the upwardly formed pairs of side and end panels.

Figure 6:
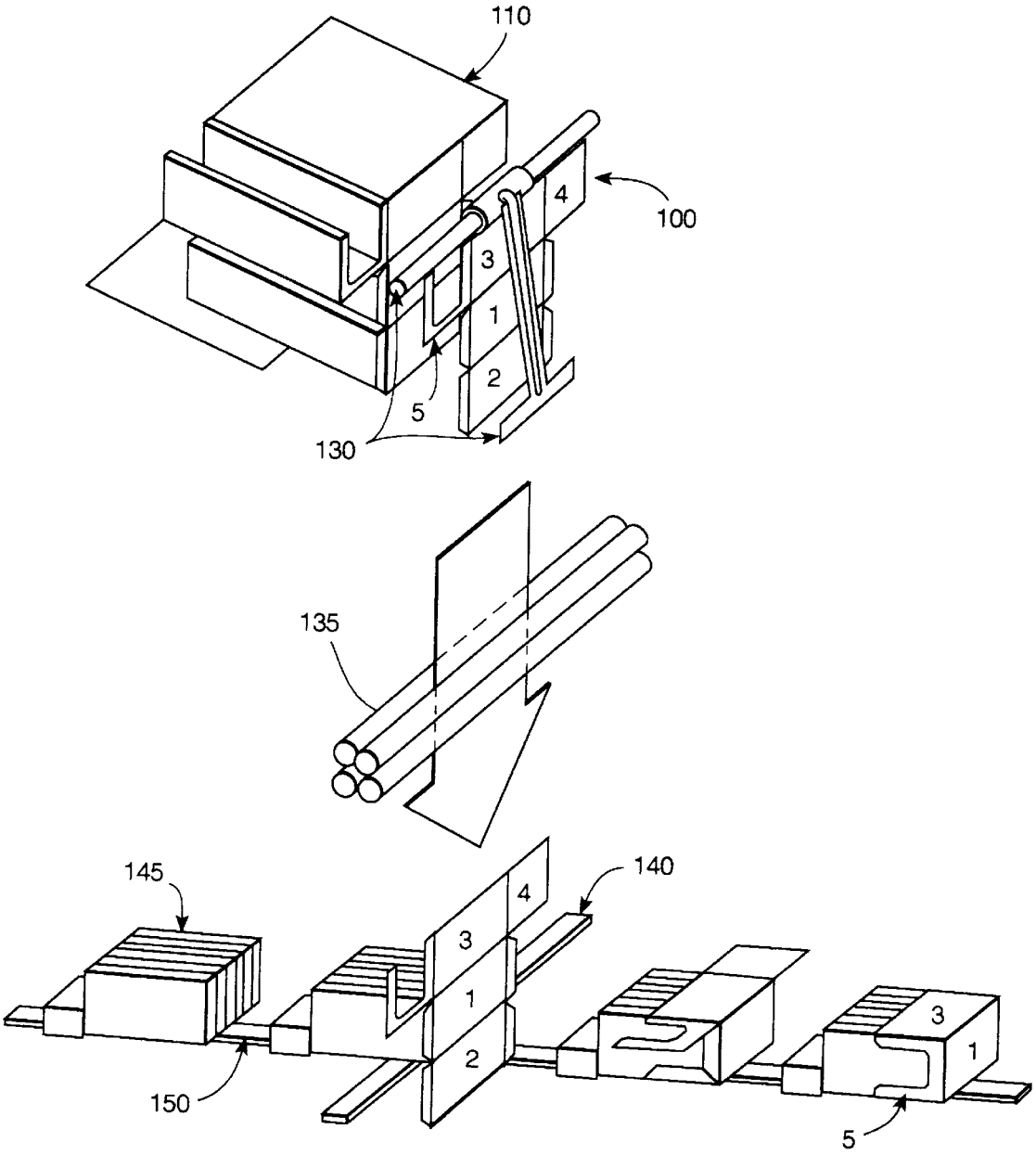
FIG. 6 depicts an assembly line process where the merchandise to be contained serves as a mandrel to permit the container to be formed around it on standard equipment.

As depicted in FIG. 6, in a preferred embodiment, a flat, glued, shippable blank may be formed into the container of the present invention using standard packaging and sealing equipment, and using the merchandise to be contained and displayed as a mandrel. In this preferred embodiment, a container blank magazine 110 feeds a blank 100 through a suction feed and pinch roller assembly 135 into a blank slot 140. Blank slot 140 holds the blank such that merchandise 145 conveyed along conveyor 150 contacts the blank at bottom panel 1. The merchandise then acts as a mandrel for folding the blank into a container for the merchandise. Thus, the forward motion of the merchandise and the blank through the packaging machinery causes folds to be made along the glue flange hinges and the edges between the panels, such that a container is formed around the merchandise. Standard features of packaging equipment provide for applying adhesive and compression as necessary, and for making the required folds and glue joints in the proper sequence. An example of packaging equipment that can be easily modified for forming a container as described above is Scandia Model 406 Automatic Carton and Sealing Machine, manufactured by Scandia Packaging Machinery Company of Clifton, N.J.

It will be apparent to those skilled in the art that various modifications can be made to this invention of a container for holding elongated objects without departing from the scope or spirit of the invention. It is also intended that the present invention cover modifications and variations of the tray for holding elongated objects within the scope of the appended claims and their equivalents.

We claim:

1. A container for displaying and vertically holding a plurality of elongated objects comprising:

a rectangular bottom having a first side edge, a second side edge, a first end edge, and a second end edge;

a first side wall extending upwardly from the first side edge and having an upper edge; and a folding panel extending from the upper edge of the first side wall, having a height slightly exceeding the height of the first side wall, having a bottom edge substantially aligned with the first side edge of the rectangular bottom, and comprising means for receiving a plurality of objects;

wherein the folding panel buckles away from the first side wall to create a structure for receiving a plurality of objects.

2. The container of claim 1, further comprising a flap extending from the the bottom edge of the folding panel, folded away from the first side edge of the rectangular bottom, and attached to the rectangular bottom.

3. The container of claim 1, further comprising:

a plurality of elongated objects positioned vertically in the container, wherein the height of the elongated objects exceeds the height of the first side wall.

4. The container of claim 1, wherein the means for receiving the plurality of objects comprises a plurality of cavities.

5. The container of claim 1, further comprising:

a second side wall extending upwardly from the second side edge;

a first end wall extending upwardly from the first end edge of the rectangular bottom, the first end wall being attached to the first side wall and the second side wall; and a second end wall extending upwardly from the second end edge of the rectangular bottom, the second end wall being attached to the first side wall and the second side wall.

6. The container of claim 5, wherein the container has one and only one folding panel comprising means for receiving a plurality of objects.

7. The container of claim 5, further comprising a second folding panel extending from the second side wall, having a height shorter than the height of the second side wall, and folded against the second side wall.

8. The container of claim 7, wherein a unitary sheet of semirigid foldable material forms the container.

9. A planar blank for forming a container for displaying and vertically holding a plurality of elongated objects, said planar blank comprising:

a first panel for forming a rectangular bottom having a first side edge, a second side edge, and opposing end edges;

a second panel for forming a first side wall extending outwardly from the first side edge and having an upper edge;

a folding panel extending from the upper edge of the second panel, having a height slightly greater than the height of the second panel, and comprising means for receiving a plurality of objects, wherein the folding panel is folded so that its bottom edge is substantially aligned with the first side edge of the first panel to form a substantially flat blank suitable for machine forming and filling;

and wherein the folding panel buckles away from the second panel when an inward fold is made along the first side edge of the first panel, thereby creating a structure for receiving a plurality of objects.

10. The planar blank of claim 9, further comprising a flap extending from the bottom edge of the folding panel, and attached to the first panel.

11. The planar blank of claim 9, wherein the means for receiving the plurality of objects comprises a plurality of cavities.

12. A container assembled by folding a unitary sheet divided by fold lines into a plurality of panels, said container comprising:

a bottom panel having a side edge;

a side panel extending from the side edge and having an upper edge; and a folding panel extending from the upper edge, having a height slightly greater than the height of the side panel, having a bottom edge substantially aligned with the side edge of the bottom panel, and comprising means for receiving a plurality of objects;

wherein the folding panel buckles away from the side panel to create a structure for receiving a plurality of objects.

13. The container of claim 12, further comprising:

a flap extending from the bottom edge of the folding panel, folded inwardly toward the center of the container, and attached to the bottom panel.

* * * * *